United States Patent [19]

Mori

[11] Patent Number: 4,594,927

[45] Date of Patent: Jun. 17, 1986

[54] PUNCH HAVING IMPROVED CUTTER ATTACHMENT MEANS

[75] Inventor: Chuzo Mori, Chiba, Japan

[73] Assignee: Carl Manufacturing Co., Ltd., Tokyo, Japan

[21] Appl. No.: 757,949

[22] Filed: Jul. 23, 1985

Related U.S. Application Data

[62] Division of Ser. No. 532,487, Sep. 15, 1983.

[30] Foreign Application Priority Data

Sep. 27, 1982 [JP] Japan ..... 57-145873
Jan. 31, 1983 [JP] Japan ..... 58-12987

[51] Int. Cl.[4] ..... B26F 1/14

[52] U.S. Cl. ..... 83/620; 83/588; 83/633

[58] Field of Search ..... 83/620, 622, 618, 632, 83/633, 639, 588, 698, 634, 687, 691

[56] References Cited

U.S. PATENT DOCUMENTS 2,017,195 10/1935 Anderson et al. ..... 83/618 X
4,166,404 9/1979 Almog ..... 83/633

FOREIGN PATENT DOCUMENTS 185147 8/1922 United Kingdom ..... 83/618
294043 7/1928 United Kingdom ..... 83/588

*Primary Examiner*—James M. Meister
*Attorney, Agent, or Firm*—Parkhurst & Oliff

[57] ABSTRACT

An improved multi-hole punch is provided in which the vertical distances between the lower ends of a multiplicity of rod cutters are gradually increased from one end to the other end of the lateral row in which the plurality of rod cutters is arranged. Thus, the rod cutters plunge into paper sheets supported on the base of the punch sequentially in the direction in which the vertical distances of their lower ends from the aforementioned portion of the base increase.

3 Claims, 18 Drawing Figures

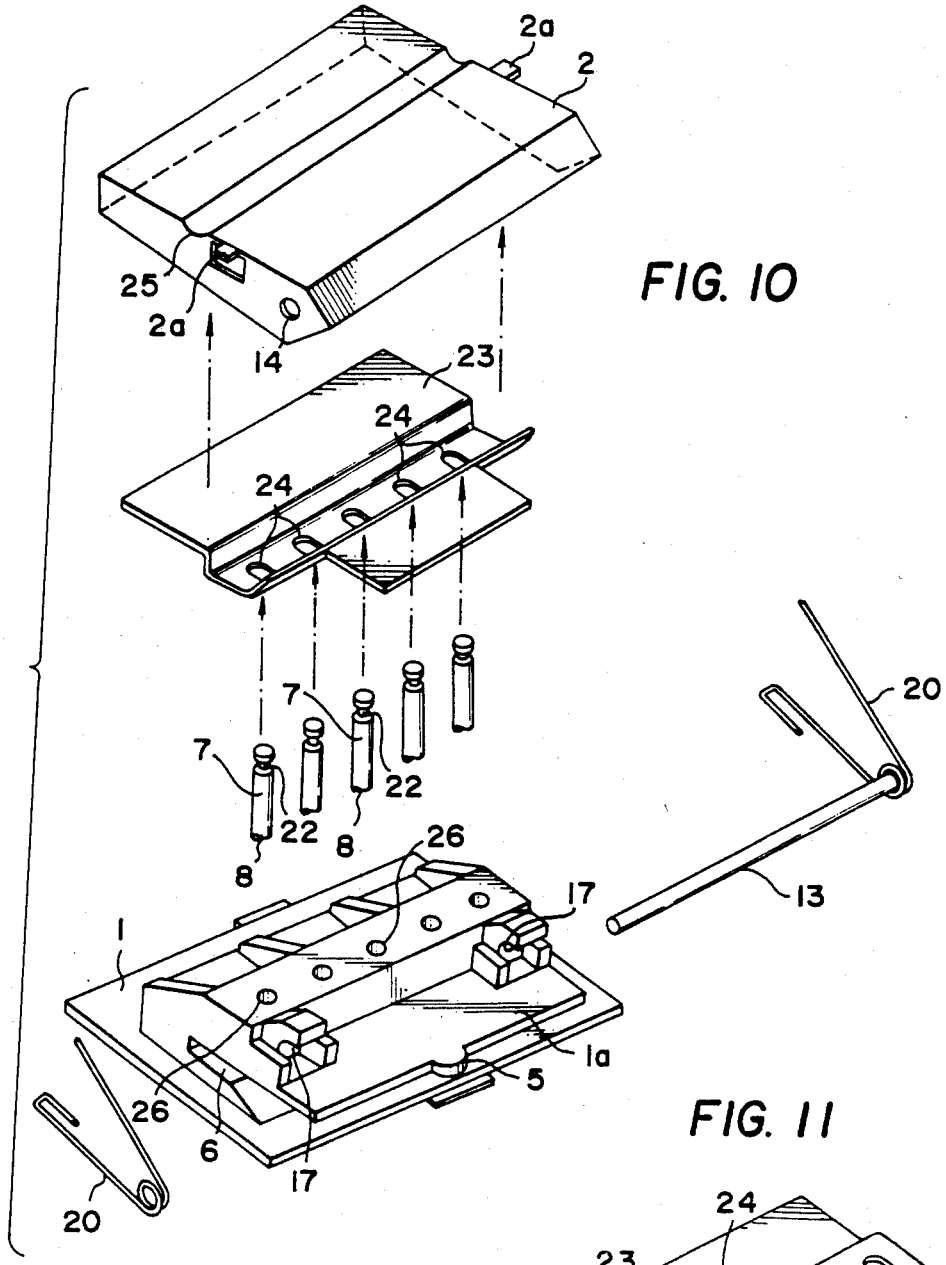
FIG. 10
FIG. 11
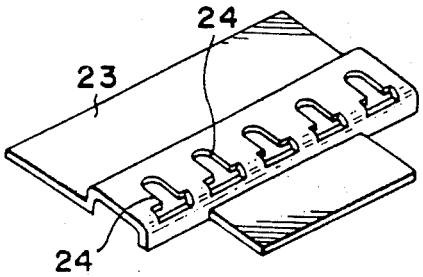

PUNCH HAVING IMPROVED CUTTER ATTACHMENT MEANS

This is a division of application Ser. No. 532,487 filed Sept. 15, 1983.

BACKGROUND OF THE INVENTION

This invention relates to a punch, and more particularly to a punch which is provided with a plurality of rod cutters.

The so-called multi-hole punch generally comprises a base incorporating therein a recess for receiving insertion of paper sheets from the front side and a part constituting the bottom surface of the recess and supporting thereon the inserted ends of paper sheets. A lever has one end thereof pivotally attached to the base so as to be freely pulled up and down relative to the base. A plurality of rod cutters is suspended and spaced in a lateral row from the aforementioned lever above the aforementioned support portion of the base. A plurality of holes equal to the number of rod cutters is formed in the support portion of the base and is adapted to permit penetration therethrough of the plurality of rod cutters which are lowered in proportion as the lever is lowered toward the base.

In the punch of this construction, since one shaft provided in the lever supports the plurality of rod cutters in position and the lower ends of the plurality of rod cutters are separated by an equal distance from the part of the base for supporting the inserted ends of paper sheets, all the rod cutters plunge into the paper sheets at the same time. If the multi-hole punch has a fairly large number of rod cutters, great force is required to lower the lever toward the base in order for the rod cutters to penetrate through the paper sheets. Thus, this multi-hole punch has suffered from the problem of inferior performance. Furthermore, it is necessary to impart increased strength to the shaft supporting the rod cutters and to the lever as well.

SUMMARY OF THE INVENTION

An object of this invention is to provide a multi-hole punch constructed so that it may be operated with slight force to perforate a plurality of holes in given paper sheets without exposing the punch itself to exertion of any immoderate external force. Since this punch uses rod cutters of a uniform length, it can be easily fabricated without necessitating any notable addition to the number of component parts or to the number of work steps in the assembly line.

The other objects and attendant merits of this invention will become apparent to those skilled in the art through the following description of preferred embodiments illustrated in the accompanying drawings.

BRIEF DESCRIPTION OF THE DRAWINGS

FIG. 10 is an exploded view of the punch of FIG. 8.

FIG. 11 is a perspective view illustrating the rod cutter retainer plate of FIG. 10 in a reversed position.

DETAILED DESCRIPTION OF THE INVENTION

The punch of this invention comprises a base incorporating therein a recess for receiving insertion of paper sheets from the front side and a support portion constituting the bottom surface of the recess and supporting thereon the inserted ends of paper sheets, a lever having one end thereof pivotally attached to the base so as to be freely pulled up and down relative to the base, a plurality of rod cutters suspended and spaced in a lateral row from the aforementioned lever above the support portion of the base, and as many holes as rod cutters formed in the support portion of the base adapted to permit penetration therethrough of the plurality of rod cutters which are lowered in proportion as the lever is lowered toward the base. The punch is characterized by causing the distance separating the lower ends of the rod cutters from the base support portion to be gradually increased from one end to the other end of the lateral row in which the plurality of rod cutters of a uniform length are arranged.

Preferred embodiments of this invention will be described below with reference to the accompanying drawings. It should be noted that these embodiments are purely illustrative of, and not limitative in any way of, the present invention.

Figure 1:
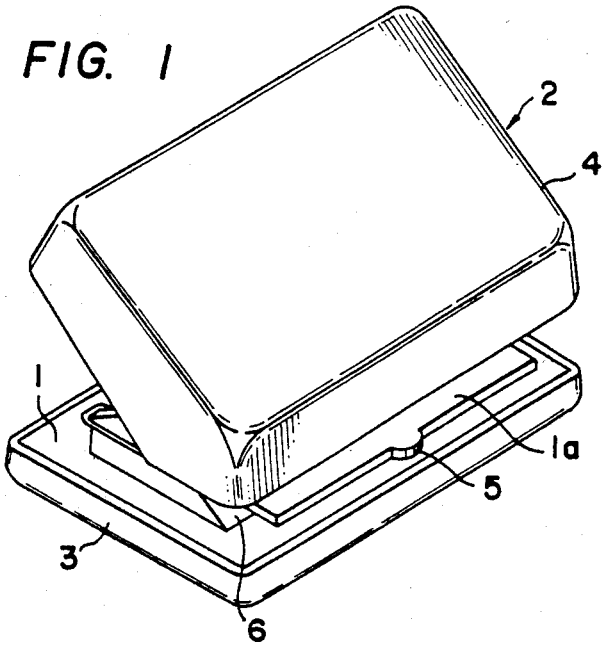
FIG. 1 is a perspective view illustrating a first embodiment of the punch of this invention.

FIG. 1 illustrates a first embodiment of this invention. In this diagram, 1 denotes a base and 2 denotes a lever having a basal part thereof pivotally attached to the base 1 so as to be freely pulled up and down relative to the base 1. The base 1 is provided with a cover 3 and the lever 2 is provided with a cover 4. A protruded front part 1*a* of the base 1 is provided with projections 5 adapted to engage with punch-positioning depressions provided on a perforation jig which will be described more fully below. Underneath the part thus provided with the projection 5 is formed a recess 6 for receiving insertion of paper sheets substantially to the center of the base 1.

Figure 2:
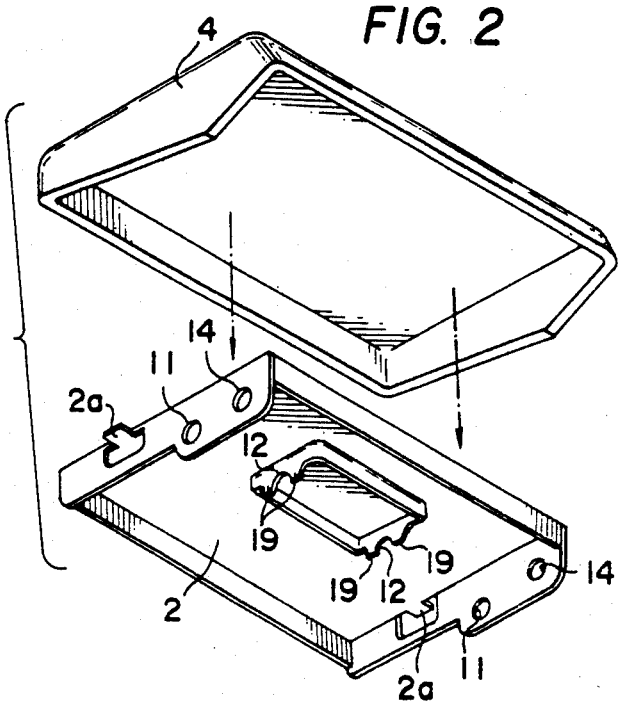
FIG. 2 is a perspective view illustrating a lever and a cover of the punch of FIG. 1 in their disassembled state.
Figure 3:
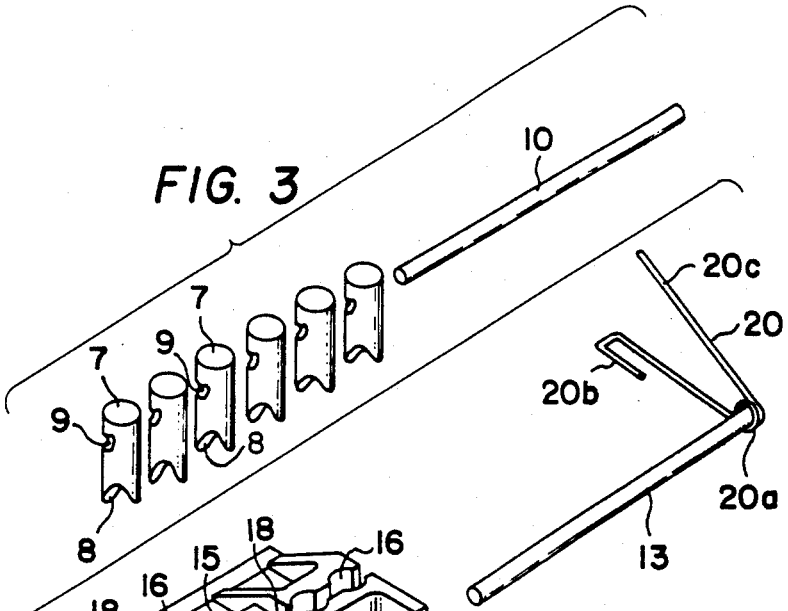
FIG. 3 is a perspective view illustrating the relation between rod cutters and a shaft for supporting the rod cutters in position in the punch of FIG. 1.
Figure 4:
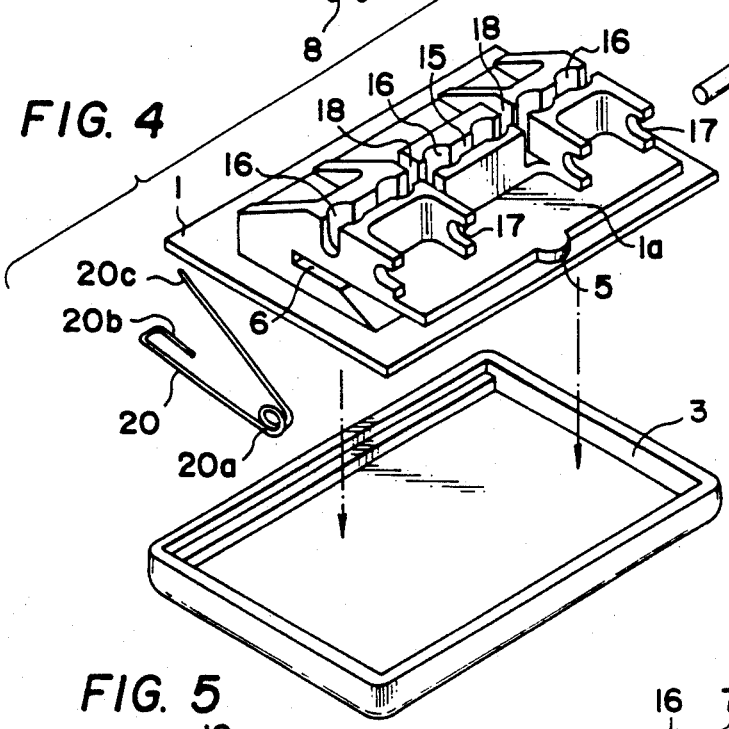
FIG. 4 is a perspective view illustrating a base and its peripheral members in the punch of FIG. 1 in their disassembled state.

The interior construction of this punch is illustrated in FIG. 2 to FIG. 4. In these diagrams, 7 denotes six rod cutters of a uniform length. Each of the rod cutters 7 is formed of a round bar having the lower end notched in the shape of the letter V to form a cutter tip 8. Through pierced holes 9 which are formed at one level in all the rod cutters, a shaft 10 is inserted. This shaft 10 is supported in position by having its opposite ends passed through holes 11 formed in each of the opposite lateral sides of the lever 2 as illustrated in FIG. 2. On the inner side of this lever 2, a rectangular wall 19 extends downwardly and dents 12 are formed in the wall so that these dents will fall flush with the holes 11 in the opposite sides of the lever. These dents 12 serve the purpose of preventing the shaft 10 from being bent by the external force exerted thereon via the rod cutters. In FIG. 4, 13 denotes a shaft with which the lever 2 is pivotally attached to the base 1. In FIG. 2, 14 denotes holes for receiving insertion of the shaft 13 into the base 1.

The base 1 is molded in one piece by die casting. As illustrated in FIG. 4, the base 1 is provided nearly at the center thereof with a groove 15 for guiding the shaft 10 in the vertical direction. Throughout the length of this groove 15, as many holes 16 as rod cutters 7 are disposed at fixed intervals for the purpose of guiding the rod cutters 7 therethrough in the vertical direction. In the front side of the base 1, four dents are provided for the purpose of receiving the shaft 13 into fast engagement therewith. In the portion of the base 1 in which the groove 15 is formed, two recesses 18 are cut perpendicularly to the groove for the purpose of admitting the raised wall 19 of the lever 2 containing the dents 12 (FIG. 2) during the descent of the lever 2.

In FIG. 4, 20 denotes wire springs. Each of the two wire springs 20 has a central coiled portion 20*a* adapted to be inserted around one of the opposite ends of the shaft 13. One hooked end 20*b* of the wire spring 20 is fastened to the rear end of the base 1. The other end 20*c* thereof is adapted to come into contact with a raised part 2*a* formed outwardly on each of the lateral sides of the lever 2. By these wire springs 20, the lever 2 is always energized in the direction of rising from the base 3.

Figure 5:
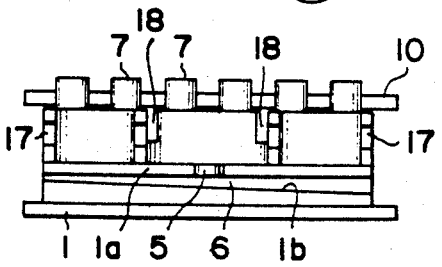
FIG. 5 is a front view of the base, illustrating the positional relation between the perforating cutters and the base in the punch of FIG. 1.
Figure 6:
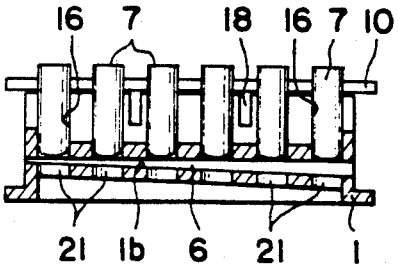
FIG. 6 is a longitudinal cross section of the construction of FIG. 5.
Figure 7:
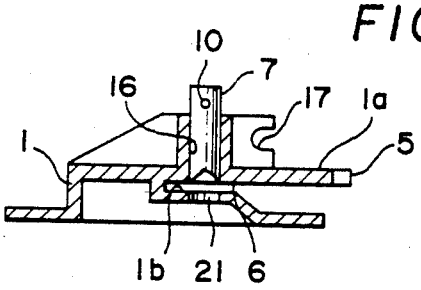
FIG. 7 is a lateral cross section of the construction of FIG. 5.

FIG. 5 to FIG. 7 illustrate the positional relation between the base 1 and the plurality of rod cutters 7. In these diagrams, a base support portion 1*b* constituting the bottom side of the recess 6 of the base 1 is inclined from one end to the other of the lateral row in which the rod cutters 7 are arranged. This support portion 1*b* is provided with holes 21 for permitting downward insertion therethrough of the rod cutters 7. This inclined support portion 1*b* is intended to enable the rod cutters 7, when paper sheets are perforated as will be described below, to plunge into the paper sheets sequentially in the direction in which the height of the inclined portion 1*b* decreases. This serves the purpose of gradually increasing the distances separating the lower ends of the rod cutters 7 from the bottom surface of the recess from one end to the other of the lateral row in which the rod cutters 7 are arranged.

Generally when the punch is used to perforate holes in paper sheets, the tips of the rod cutters lowered toward the paper sheets by the operation of the lever are first pressed against the upper surface of the paper sheets supported on the part of the base designed to keep their inserted ends in position. These tips then plunge into the paper sheets to effect the desired perforation. When the support portion 1*b* of the base 1 is inclined as contemplated by the present invention, therefore, the rod cutters 7 located where the height of the inclined portion 1*b* is larger plunge into the paper sheets earlier than those located where the height is smaller. Thus, the perforation of paper sheets will advance in the direction in which the height decreases. Unlike perforation in which all the tips of the rod cutters simultaneously plunge into paper sheets, perforation by the punch of this invention can be obtained by application of slight pressure on the lever.

Figure 8:
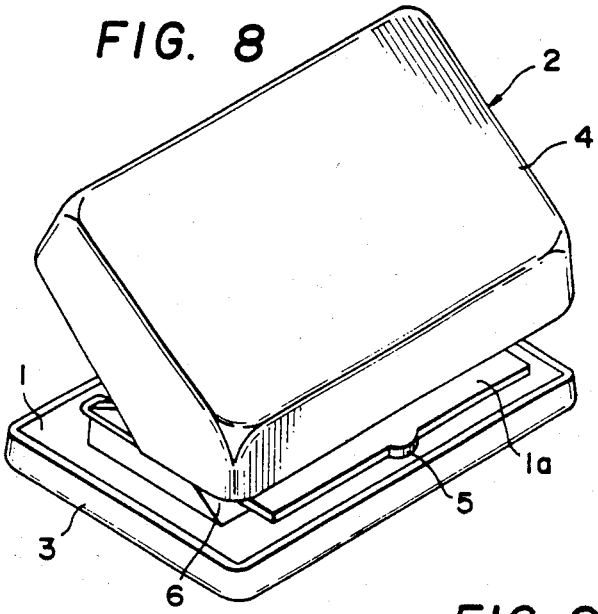
FIG. 8 is a front view illustrating a punch as a second embodiment of this invention.
Figure 9:
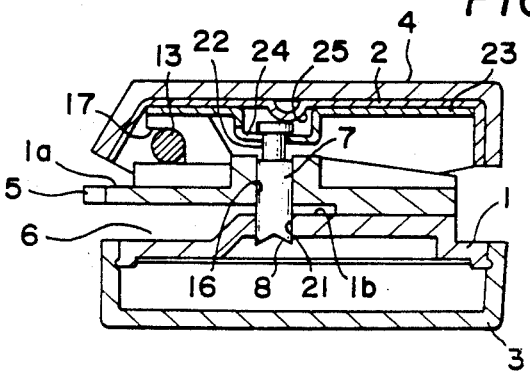
FIG. 9 is a cross section of the punch of FIG. 8.
Figure 12:
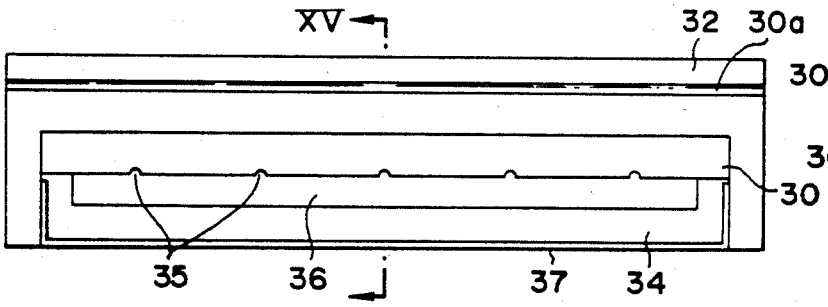
FIG. 12 is a plan view illustrating a typical perforation jig.
Figure 13:
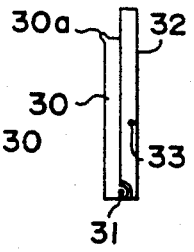
FIG. 13 is a right-side view of the perforation jig of FIG. 12.
Figure 14:
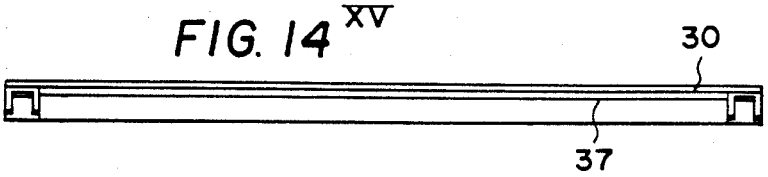
FIG. 14 is a front view of the perforation jig of FIG. 12.

FIG. 8 to FIG. 10 illustrate a second embodiment of this invention. This punch differs from the first embodiment described above in terms of the manner in which the rod cutters 7 are supported by the lever 2. In all other respects, the second embodiment is substantially identical with the first embodiment. Thus, only the points of difference will be described below.

With reference to FIG. 9 and FIG. 10 which illustrate a cross-sectional construction and a disassembled internal construction respectively of the punch of FIG. 8, annular grooves 22 are formed at a fixed level in the upper portions of the rod cutters 7 of uniform length. The rod cutters 7 are held in position relative to the lever 2 by these annular grooves 22 being fitted in the holes 24 of a rod cutter retainer plate 23 which is formed integrally with the lever 2. The rod cutter retainer plate 23 assumes a bent shape at least in the portion thereof in which the holes 24 are provided. These holes 24 are formed each in the general shape of the letter T, so that the rod cutters 7 may be inserted first through the larger righthand portions of these holes 24 relative to the position illustrated in FIG. 10 and FIG. 11 and then slid sideways for their annular grooves 22 to come into fast engagement with the bottoms of the T shaped holes. The lever 2 has a depression 25 formed in its upper side throughout the entire longitudinal extent thereof. The depression 25 is formed so that the bottom thereof will abut intimately upon the heads of the rod cutters 7.

Along substantially the center of the base 1, as many holes 26 as rod cutters 7 are provided in a row for the purpose of guiding the vertical motion of the rod cutters 7 therethrough. The support portion 1*b* of the base 1 is inclined in the same manner as in the first embodiment. This portion 1*b* is provided with holes 21 which permit penetration therethrough of the rod cutters 7.

When the component parts of the punch of the foregoing construction are assembled to produce a finished punch, the rod cutters 7 are inserted into the corresponding holes 24 of the rod cutter retainer plate 23 through the larger righthand portions of the holes 24 as the plate is held in the position of FIG. 10 and subsequently slid sideways for the grooves 22 to come into tight engagement with the bottoms of the T-shaped holes. By this arrangement, therefore, the rod cutters can be easily secured in position without requiring a shaft 10 adapted to be pierced through the holes formed in the upper portions of the rod cutters, as is required in the first embodiment. This arrangement proves particularly advantageous where the rod cutters 7 having too small a diameter to permit perforation therethrough of those holes for passage of the shaft 10 are to be safely secured to the lever 2. By the synergism between the smallness of the diameter of the rod cutters and the inclination of the portion 1*b*, the punch of this embodiment requires much less force to lower the lever relative to the base 1 than the conventional punch, thereby improving the performance of the punch.

The punch of the present invention so far described can be used independently to perforate a plurality of holes in given paper sheets by one action of its lever. When it is used in combination with a perforation jig which will be described below, it can perforate as many holes as desired in, for instance, refill sheets for a loose leaf notebook.

The perforation jig will be described with reference to FIG. 12 to FIG. 18. This perforation jig comprises an upper plate 30 of the shape of a rectangular picture frame lacking one larger side adapted to receive the punch into abutment thereon, a lower plate 32 of substantially the same shape as the upper plate 30 pivotally attached to the upper plate 30 with a hinge structure such as shafts 31, and a sheet-positioning plate 34 pivotally attached with a shaft 33 to the middle portion of the lower plate 32. Denoted by 30*a* is a handle for the upper plate 30.

Figure 18:
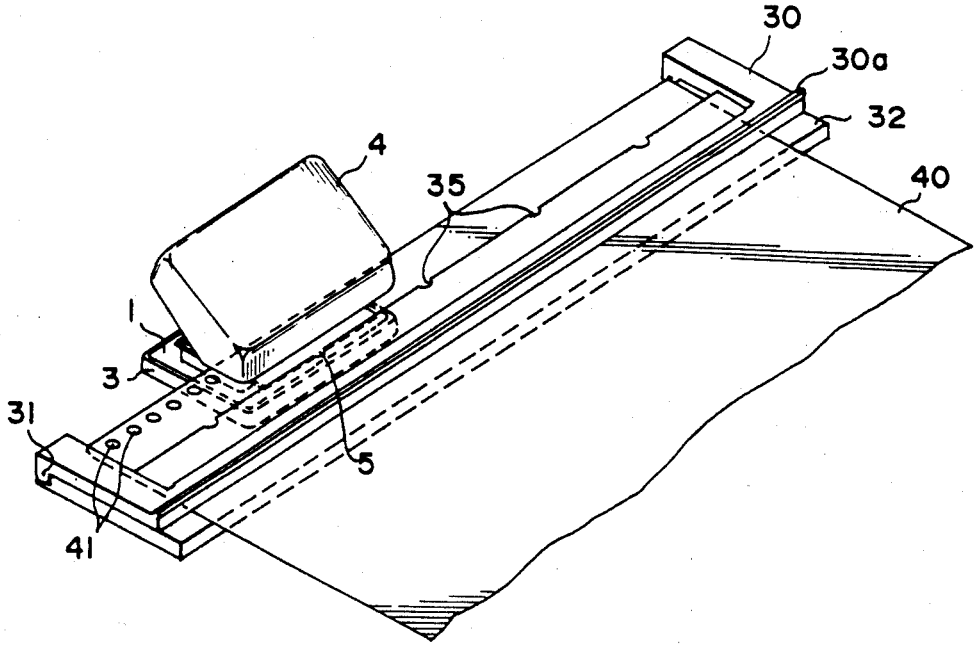
FIG. 18 is a perspective view illustrating the condition in which the punch of FIG. 1 is abutted against the perforation jig of FIG. 12 in preparation for perforation of paper sheets.

As may be clearly seen in FIG. 18, the upper plate 30 is provided along the longitudinal edge thereof with depressions 35 spaced regularly in a row so as to fit respectively around the projections 5 formed on the punch of FIG. 1. By fitting the projections of the punch into the depressions 35 of the upper plate 30 sequentially from one end to the other end of the upper plate 30, numerous holes can be formed in refill sheets. The portion 36 of the lower plate 32 which is protruded outwardly from the edge of the upper plate 30 containing the depressions 35 advances into the recess 6 formed in the front portion of the punch when the punch is abutted against the perforation jig and consequently fulfills the role of preventing the punch from producing a vertical vibration relative to the paper sheets.

Figure 15:
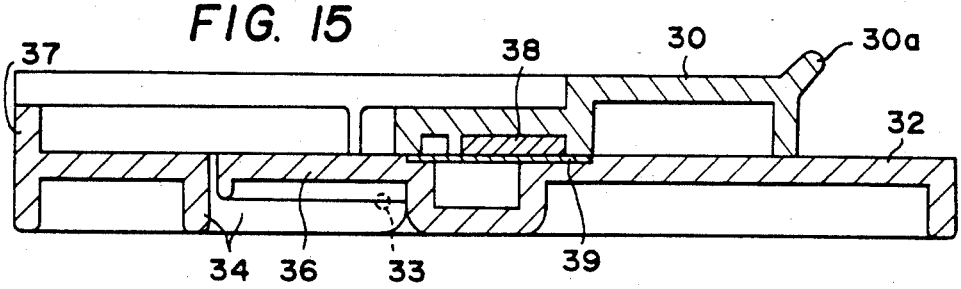
FIG. 15 is an enlarged cross section taken along the line XV—XV in the diagram of FIG. 12.

The sheet-positioning plate 34 is provided with a raised edge adapted to fix the position of inserted paper sheets relative to the perforation jig. As illustrated in FIG. 15, a magnetic plate 38 is fastened to the upper plate 30 and an iron plate 39 is fastened to the lower plate 32. The magnetic plate 38 and the iron plate 39 are intended to keep the upper plate 30 and the lower plate 32 in intimate contact with each other.

Optionally, the relation between the projections 5 of the punch and the depressions 35 of the perforation jig may be reversed.

Figure 16:
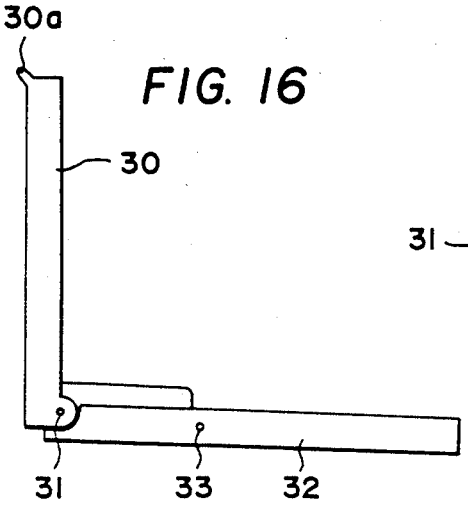
FIG. 16 is an enlarged side view of the perforation jig of FIG. 12, illustrating the upper plate opened relative to the lower plate.
Figure 17:
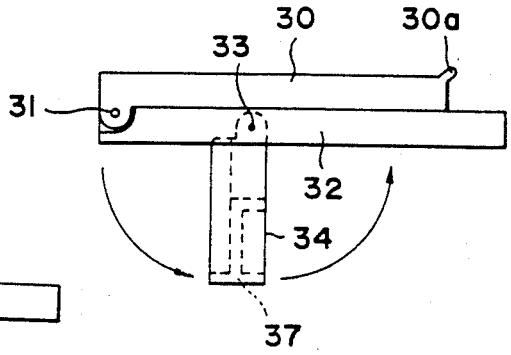
FIG. 17 is an enlarged side view of the construction of FIG. 14, illustrating the condition in which the upper plate has been pulled down toward the lower plate from the position shown in FIG. 16 and the sheet-positioning plate has been rotated down below the lower plate.

Now, perforation of a multiplicity of holes in given paper sheets by the punch of this invention with the aid of this perforation jig will be described. First, while the upper plate 30 is kept raised relative to the lower plate 32 as illustrated in FIG. 16, the paper sheets 40 are inserted from the right side onto the lower plate 32. In the meanwhile, the sheet-positioning plate 34 is kept in such a state that the upper surface thereof may fall flush with the upper side of the lower plate 32 so that the leading ends of the paper sheets 40 may be allowed to advance until they abut against the raised edge 37. Thus, the paper sheets are correctly positioned relative to the perforation jig. Then, the upper plate 30 is closed toward the lower plate 32 until the two plates take firm hold of the paper sheets 30, and the sheet-positioning plate 34 is rotated as illustrated in FIG. 17 until if falls below the lower plate 32. Consequently, the edge of the upper plate 30 containing the depressions 35 emerges in the front end and the paper sheets 40 are further protruded from the front end. Then, the protruded ends of paper sheets 40 are inserted into the recess from the front side of the punch, the projections 5 of the punch are abutted against the depressions 35 of the perforation jig, and the lever 2 is pressed down. Consequently, the punch forms holes 41 in the paper sheets (FIG. 18). When this cycle of perforation is repeated until all the depressions 35 in the perforation jig are abutted upon by the projections of the punch, there will be formed in the paper sheets as many holes as desired.

Since this invention is constructed as described above, it enables a plurality of holes to be readily perforated in given paper sheets with only slight force. Further, because the punch itself is not subject to any immoderate external force, the strength of the lever or any other component part serving to support the rod cutters is not required to be so large as in the conventional multi-hole punch. This fact constitutes a major merit with respect to the fabrication of a punch.

What is claimed is:

1. A punch comprising a base portion, a lever portion and a row of rod cutters, said lever portion being pivotally attached to said base portion and having suspended therefrom said row of rod cutters;

said base portion incorporating therein a recess for receiving insertion of paper sheets and a support portion forming a bottom surface of said recess for supporting thereon the inserted ends of paper sheets;

said support portion of said base having a hole therein corresponding in position to a lower end of each of said plurality of rod cutters, said holes being adapted to permit penetration therethrough of said plurality of rod cutters upon lowering of said lever toward said base;

a distance, between said lower ends of said plurality of rod cutters and said support portion of said base, gradually increasing from one end to an opposite end of the lateral row of rod cutters;

an annular groove formed in an upper portion of each said rod cutter at a fixed distance from a top end of said rod cutter;

holes adapted to fit around said annular groove formed in a lower side of said lever to support said plurality of rod cutters relative to said lever; and a depression formed on an upper side of said lever, such that the bottom of said depression abuts intimately upon the heads of said rod cutters.

2. A punch according to claim 1, wherein said holes in said lever have a "T" shape.

3. A punch comprising a base portion, a lever portion and a row of rod cutters;

said lever portion being pivotally attached to said base portion and having suspended therefrom said row of rod cutters;

said base portion incorporating therein a recess for receiving insertion of paper sheets and a support portion forming a bottom surface of said recess for supporting thereon the inserted ends of paper sheets;

said support portion of said base having a hole therein corresponding in position to a lower end of each of said plurality of rod cutters, said holes being adapted to permit penetration therethrough of said plurality of rod cutters upon lowering of said lever toward said base;

an annular groove formed in an upper portion of each said rod cutter at a fixed distance from a top end of said cutter;

holes adapted to fit around said annular groove formed in a lower side of said lever to support said plurality of rod cutters relative to said lever; and a depression formed on an upper side of said lever, such that the bottom of said depression abuts intimately upon the heads of said rod cutters.

* * * * *